United States Patent [19]

Henderson

[11] Patent Number: 4,653,383

[45] Date of Patent: Mar. 31, 1987

[54] OIL WELL SUB-SURFACE PUMP STROKE EXTENDER

[76] Inventor: Tom Henderson, P.O. Box 253, Taft, Calif. 93268

[21] Appl. No.: 649,992

[22] Filed: Sep. 13, 1984

[51] Int. Cl.[4] ..... F15B 15/22; F04B 37/00

[52] U.S. Cl. ..... 92/13.1; 74/586

[58] Field of Search ..... 92/13.1, 13; 74/586; 417/545

[56] References Cited

U.S. PATENT DOCUMENTS

| | | | |
|---|---|---|---|
| 2,715,389 | 8/1955 | Johnson | 92/13.1 X |
| 3,102,486 | 9/1963 | Griswold | 92/13.1 |
| 4,187,765 | 2/1980 | Mattoon | 92/13.1 |
| 4,296,678 | 10/1981 | Felder | 92/13.1 |
| 4,370,901 | 2/1983 | Bolen | 74/586 |
| 4,498,845 | 2/1985 | Pittman et al. | 92/13.1 X |

*Primary Examiner*—A. Michael Chambers
*Assistant Examiner*—John C. Fox
*Attorney, Agent, or Firm*—Sixbey, Friedman & Leedom

[57] ABSTRACT

The pump stroke extender adjusts the stroke of a polish rod normally clamped to a connector cable of an oscillating horse head for operating a sub-surface oil well pump. The extender includes a cylinder having its sides, in the preferred embodiment, connected to the double cables (connector cable) from the horse head and a piston portion clamped to the polish rod. A source of hydraulic fluid connects to the cylinder and appropriate valving arrangements cause in-flow of fluid to the cylinder to extend the piston portion from the cylinder as the polish rod approaches one end of its stroke. Hydraulic fluid is drained from the cylinder as the polish rod approaches the opposite end of its stroke. The overall stroke length of the pump can thus be extended by the travel distance of the piston relative to the cylinder, or, alternately, can be decreased by the travel distance of the piston relative to the cylinder.

14 Claims, 5 Drawing Figures

OIL WELL SUB-SURFACE PUMP STROKE EXTENDER

FIELD OF THE INVENTION

This invention relates generally to oil well operations and more particularly to oil well sub-surface pumps for extracting oil from a well after completion.

BACKGROUND OF THE INVENTION

Pumps for extracting oil from oil wells include elongated cylinders lowered into the well with a piston and piston rod connected through appropriate links to the surface. Valves are incorporated in the lower end of the cylinder and in the piston so that reciprocating movement of the piston in the cylinder will draw up oil to the surface. The piston rod connectors up to the surface terminate in what is called a polish rod extending through an appropriate seal from the upper end of the well. This polish rod is connected to a connector cable associated with a reciprocating member referred to as a horse head. The horse head is caused to oscillate up and down by an appropriate drive at the surface of the well.

Given fixed dimensions for the pump cylinder within the well, the rate of pumping of oil will depend on the overall length of the pump stroke and the number of strokes per unit time. Normally there is an optimum speed of operation for the pump. That is, the horse head type pumps best operate at a uniform given rate of reciprocation. Therefore, the only means for varying the rate at which oil is removed from the well is by varying the pump stroke.

It is to be appreciated that the effective pump stroke in removing oil in itself varies depending upon the depth of the well. For extremely deep wells, there is necessarily a "stretching" of all of the connecting rods between the polish rod and the pump piston at the bottom of the well. In other words, a certain part of the stroke is taken up in simply "stretching" the rods before actual movement of the lower end of the rod occurs. The same situation obtains on the downstroke of the pump.

In addition to the foregoing, after prolonged pumping of wells, the available oil at the bottom of the well may decrease or be more difficult to "suck" out of the formations. For this reason it may be desirable to utilize a shorter stroke to effectively decrease the rate of pumping of the oil to better match the situation in the formations.

Heretofore, the pump stroke of the horse head type rocking pumps has been varied by simply shifting the pivot point of the Pittman with respect to the crank arm, or by any other equivalent means shortening the crank arm which drives the Pittman which in turns rocks the walking beam carrying the horse head back and forth. Such an operation requires personnel to visit the field with appropriate tools and to shut down the pumping operation until appropriate adjustments have been completed. These adjustments are a time consuming operation and must be carried out every time. it appears desirable to change the pump stroke.

BRIEF DESCRIPTION OF THE PRESENT INVENTION

With the foregoing considerations in mind, the present invention contemplates an improved means for varying the stroke of an oil well sub-surface pump which is considerably simpler than present-day means and therefore will afford a considerable savings in time and money.

More particularly, rather than shift pivot points and the like on the existing structure, a simple telescoping means is connected in series with the polish rod and connector cable on the horse's head. First means are then provided for extending the axial length of the telescoping means as the polish rod approaches one end of its stroke and second means are provided for retracting the overall length of the telescoping means as the polish rod approaches the opposite end of its stroke.

In the preferred embodiment of the invention, the telescoping means includes a cylinder and piston operated by hydraulic fluid.

BRIEF DESCRIPTION OF THE DRAWINGS

A better understanding of this invention will be had by now referring to the accompanying drawings in which.

DETAILED DESCRIPTION OF THE FIRST SIMPLIFIED VERSION OF THE INVENTION

Figure 1:
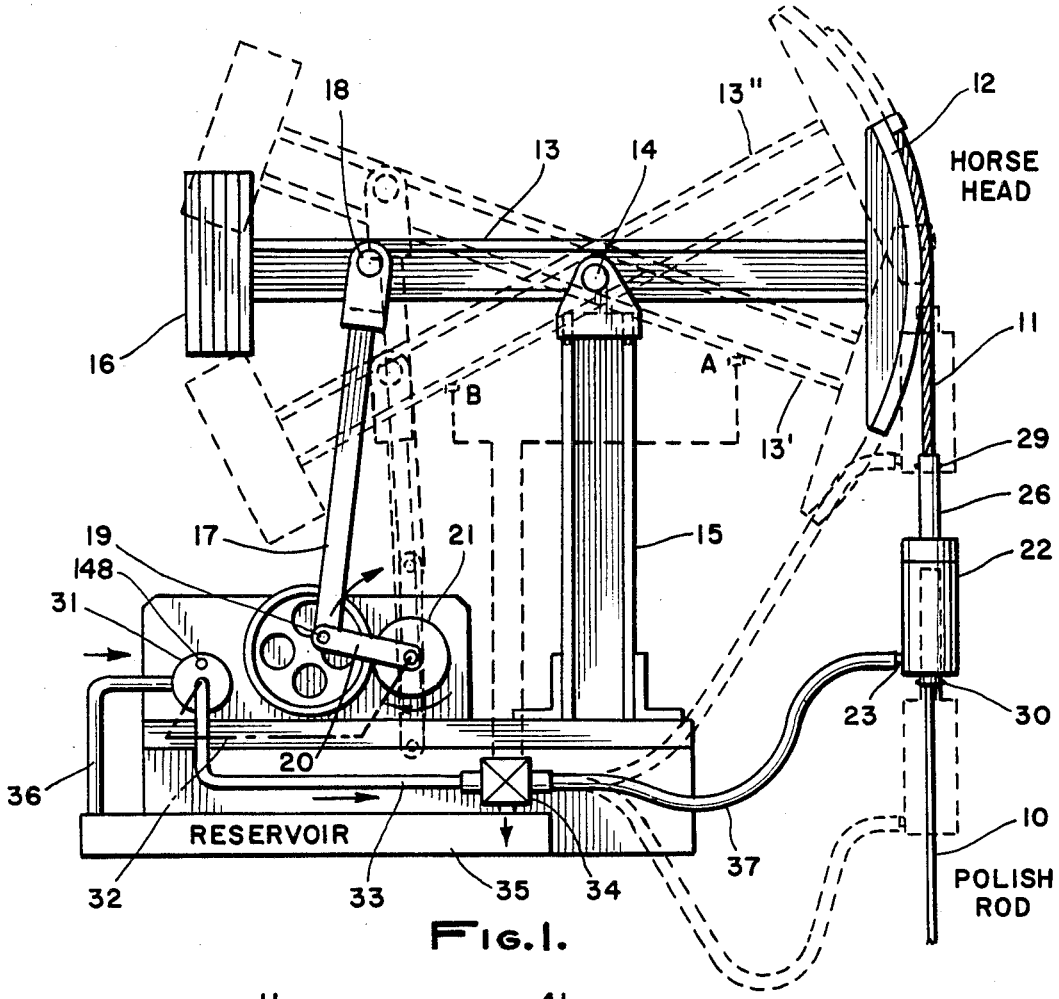
FIG. 1 is a side elevational view partly schematic in form of a simple oil well sub-surface pump drive of the horse head type using a first version of the stroke extender of this invention.

Referring to the lower right hand portion of FIG. 1, there is shown the extending end of a polish rod 10 from a sub-surface pump in an oil well. The upper end of this polish rod 10 normally connects to the connector cable 11 of an oscillating horse head 12. Oscillating horse head 12 is carried on a structural member 13 referred to as a walking beam. Walking beam 13 is pivoted at 14 to the upper end of a support stand 15. A counter weight 16 for the walking beam 13 is mounted on the end opposite the horse head 12 as shown.

It will be appreciated that by oscillating the walking beam 13 back and forth between the phantom line positions 13' and 13'' the horse head 12 will move up and down and the connector cable 11 will raise and lower the polish rod in a rectilinear vertical direction.

To oscillate the walking beam 13, there is provided a Pittman 17 pivoted at its upper end to the walking beam at 18 and at its lower end at 19 to the end of a crank arm 20. The other end of the crank arm 20 is driven by a motor 21. It will be appreciated that rotation of the crank arm 20 by the motor 21 will result in the described oscillating movement of the walking beam 13 and horse head 12.

With a fixed length of crank arm 20, Pittman 17, and fixed spacing between the various pivot points, the amplitude of oscillation of the horse head 12 is fixed and therefore the stroke length of the polish rod is normally fixed when the upper end thereof is attached to the connector cable 11.

In order to extend the stroke of the polish rod in accord with the present invention, there is provided the stroke extender of the present invention. This stroke extender comprises a telescoping means arranged to be connected between the upper end of the polish rod 10 and the lower end of the connector cable 11 from the horse head 12.

In the particular embodiment shown, the telescoping means includes a cylinder 22 having a hydraulic inlet means 23 in its lower end.

Figure 2:
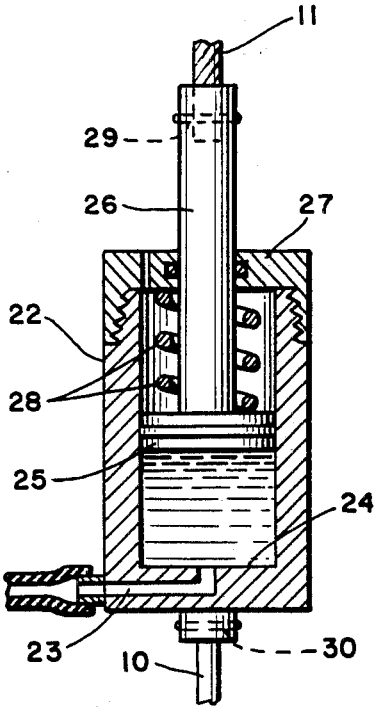
FIG. 2 is an enlarged fragmentary view of a portion of the stroke extender utilized in the pump of FIG. 1.

Referring to the enlarged cut-away view of the cylinder 22 shown in FIG. 2, it will be noted that the hydraulic inlet 23 passes up through the floor 24 of the cylinder.

Positioned within the cylinder is a piston 25 having a piston rod 26 extending through the head 27 of the cylinder. A compression spring 28, in turn, is positioned between the top of the piston 25 and the underside of the head 27 on the cylinder so as to urge the piston 25 towards the floor 24 of the cylinder. Means 29 are provided for attaching the top extending end of the piston rod 26 to the connector cable 11 as described in FIG. 1 and a similar means 30 may be provided to connect the top of the polish rod 10 to the lower end of the cylinder as shown.

It can be appreciated from the description thus far, that if the piston rod 26 can be caused to extend from the cylinder 22 as the horse head 12 is moving downwardly, the stroke will be increased. Similarly, if the piston 26 can be caused to retract into the cylinder 22 as the horse head 12 is moving upwardly, the stroke will be increased. The overall increase of the stroke, in fact, would then be equal to the travel distance of the piston relative to the cylinder 22.

In FIG. 1, the foregoing action is depicted by the dotted line showings of the piston and cylinder when the horse head 12 is in its up position and in its lower position. Thus, in the lower position, it will be noted that the piston is extended fully from the cylinder while in the upper position the piston rod is retracted in the cylinder.

In order to control the extending and retracting of the piston rod relative to the cylinder 22, hydraulic fluid may be introduced through the inlet 23 and also drained through this same inlet. It should be understood that the use of hydraulic fluid is simply one example of a means for effecting the desired telescoping action of the stroke extender.

Referring to the left portion of FIG. 1, one example of a means for controlling the flow of hydraulic fluid when hydraulic fluid is used, is shown. This means includes a hydraulic pump 31 arranged to be driven from the motor 21 as indicated by the mechanical line connection schematically at 32. Hydraulic fluid from the pump 31 passes through pipe 33 to a valve 34. Hydraulic fluid for the pump is provided by a reservoir 35 by way of line 36 to the inlet of the pump 31.

When the valve 34 is in a first position, hydraulic fluid is pumped from line 33 directly into line 37 to the cylinder inlet 23 thereby extending the piston rod 26 from the cylinder. When the valve 34 is in the second position, hydraulic fluid is drained from the cylinder to the reservoir 35. By controlling the first and second positions of the valve 34, the time that the piston rod is being extended from the cylinder 22 can be controlled and the time that the piston rod 26 is being retracted into the cylinder 22 can be controlled.

In FIG. 1, an example of one type of control is shown. This control takes the form of micro switches designated A and B positioned under the walking beam 13 such that when the horse head 12 is in its lowermost position such as indicated by the phantom line positioning of the walking beam at 13', the micro switch A will be actuated. When the horse head 12 is in its highest position, so that the walking beam 13 assumes the phantom line position 13'', the micro switch B is engaged.

Figure 3:
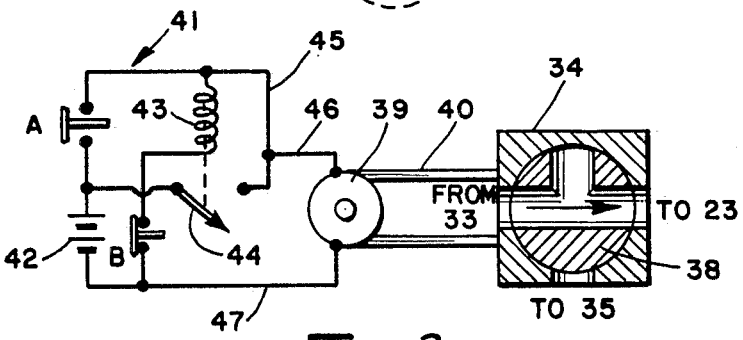
FIG. 3 is a partly schematic and partly electrical diagram of a part of the extending and retracting means in a first position for effecting an extension of the extender of FIG. 2.
Figure 4:
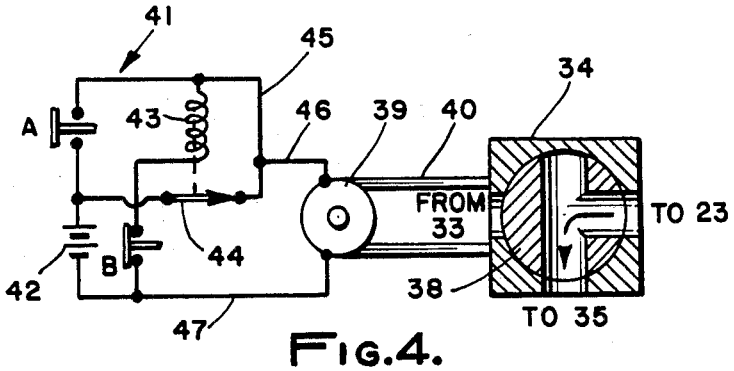
FIG. 4 is a view similar to FIG. 3, but showing components in a second position for enabling retraction of the extender.

Micro switches A and B serve to operate a rotary solenoid in turn arranged to operate the valve 34 all as will now become clearer by referring to FIGS. 3 and 4.

In FIG. 3, the rotary valve 34 is shown as including a rotary member 38 in a position to pass fluid from the line 33 to the inlet 23. Movement of the rotor 38 is controlled by a rotary solenoid schematically indicated at 39 by way of a chain or belt 40. Rotary solenoid 39 when energized will rotate 90° in a clockwise direction. When de-energized, the rotary solenoid 39 will return to its initial position and thereby return the rotor 38 of the valve to its initial position.

Energization of the rotor solenoid 39 is effected by an appropriate circuit designated generally by the numeral 41.

Referring to the lower left portion of the circuit, it includes a battery 42 connected in series with the micro switch A. Micro switch A is normally in an open position. Across the battery 42 and micro switch A is connected a relay coil 43. Micro switch B is connected in series with relay coil 43. Micro-switch B is normally closed. The circuit 41 is completed by a switch arm 44 associated with the relay 43 which, when closed, will apply energy from the battery 42 through lead 45 to the top of the relay coil 43 and through lead 46 to one side of the rotary solenoid 39. The other side of the rotary solenoid 39 is connected to a return lead 47 to the battery 42.

Operation

In operation, when the walking beam 13 assumes the phantom line position 13' shown in FIG. 1, the micro switch A will be momentarily closed.

Referring to FIG. 3, when micro switch A is closed, energy from battery 42 will pass through the closed micro switch A to the top of relay coil 43 and thence through the relay coil 43 and normally closed micro switch B to the other side of the battery 42. Energization of the relay coil 43 will close switch arm 44. When switch arm 44 is closed, energy from the battery 42 will be applied directly through the closed switch arm 44 and lead 45 to the top of the relay coil 43 thereby locking in the relay; that is, maintaining the coil 43 energized even though micro switch A opens up.

Energy from the battery 42 passing through the switch arm 44 will also pass through lead 46 to the rotary solenoid 39 and thence back to the battery by way of lead 47. Energization of the rotary solenoid 39 will now move the rotor 38 of the valve 34 90° to the position depicted in FIG. 4.

It will be understood that when the rotor valve 38 was in the position shown in FIG. 3, hydraulic fluid had entered the cylinder 22 and extended the piston 26 to its maximum extent as illustrated in the lower phantom line position of the cylinder 22 in FIG. 1. It was at this lowest position that the micro switch A was closed as above described to shift the position of the rotor valve 38 to that shown in FIG. 4.

Referring now to FIG. 4, it can be seen that when the rotor 38 of the valve is in the position shown, hydraulic fluid will drain from the lower end of the cylinder inlet at 23 to the reservoir 35 by way of the valve. This draining will continue so long as rotor 38 is held in the position shown in FIG. 4 and the rotor will be held in such position so long as the rotary solenoid 39 remains energized.

As a consequence, the spring 28 described in FIG. 2 will retract the piston rod 26 into the cylinder 22 as the horse head moves from its lowest position towards its upper position. It can therefore be seen that the polish rod 10 will actually be pulled up a greater length than would occur in the absence of the cylinder and piston; or in the event that the piston 26 was not retracted into the cylinder as the horse head is rising.

When the horse head reaches its topmost position as shown in FIG. 1 in phantom lines, the walking beam 13 assumes the position 13" and the micro switch B is engaged.

Referring to FIG. 4, when the normally closed micro switch B is engaged, it will open, there opening the circuit to the relay coil 43. When this circuit is opened, relay coil 43 is de-energized and switch arm 44 will open to its position illustrated in FIG. 3 thereby removing energy from the rotary solenoid 39. The rotor 38 of the valve 34 will then automatically return to the position illustrated in FIG. 3 and once again hydraulic fluid will be passed into the cylinder to start extension of the rod 26 as the horse head moves downwardly.

The above-described operation will then repeat when the horse head reaches its lowermost position.

It can be appreciated as already mentioned that the stroke of the polish rod is effectively increased by the distance travelled by the piston relative to the cylinder.

As a result of the foregoing, the stroke can not only be extended but it may similarly be reduced and even intermediate values within a given range realized. For example, to reduce the stroke, the positions of the micro switches A and B would be reversed so that as the horse head is rising, the piston 26 would be extended from the cylinder 22 rather than retracted. On the downward movement of the horse head, the piston 26 would be retracted into the cylinder 22. The result is that the polish rod stroke would be reduced by an amount equal to the travel distance of the piston relative to the head.

Essentially, the control valve 34 and associated rotary solenoid 39 and control circuit 41 function as a hydraulic fluid inlet control means responsive to a first given position of the horse head to introduce hydraulic fluid into the cylinder to urge the piston upwardly and extend the piston rod further from the head thereby increasing the distance between the connecting cable for the horse head and the polish rod. The same components also function as hydraulic fluid drain means which is responsive to a second given position of the horse head to drain hydraulic fluid from the cylinder thereby causing retraction of the piston rod into the cylinder by the spring to thereby decrease the distance between the connector cable for the horse head and the polish rod.

The actual amount that the stroke is extended or reduced can be controlled by controlling the travel distance of the piston 26 relative to the cylinder 22. One such means for controlling this travel distance is by controlling the rate of hydraulic fluid flow into and from the cylinder 22.

Towards the foregoing end, there is shown in FIG. 1 for the hydraulic pump 31 a control 148 which will enable adjustment of the rate of hydraulic fluid flow through the line 33 and thence into the cylinder 22. Since the oscillation period of the horse head is constant; that is, since the length of time between operation of the micro switches A and B is constant if the flow rate of fluid is decreased, then the piston will have travelled a lesser distance within such time period.

On the other hand, if the rate of fluid flow is increased, then the piston will travel a greater distance during the given time period.

It can now be appreciated that when it becomes desirable to change the stroke of the polish rod in a field pumping operation a worker need only come out and adjust the rate of flow of fluid by the hydraulic motor 31 by way of adjustment 148. Also, as stated, the positioning of the micro switches A and B may be appropriately controlled to effect the desired extension or retraction of the overall stroke length. It is not necessary to bring special tools or to disassemble the basic components of the sub-surface pump actuator structure itself.

DETAILED DESCRIPTION OF THE PREFERRED EMBODIMENT OF THE INVENTION

In many systems the horse head connector cable is a double cable with the polish rod extending up between the two cables and being clamped at a given location therebetween. The start position of the stroke can thus be adjusted by changing the clamp positon of the cablcs to the polish rod.

The stroke extender in the preferred embodiment is designed to accommodate the foregoing construction.

Figure 5:
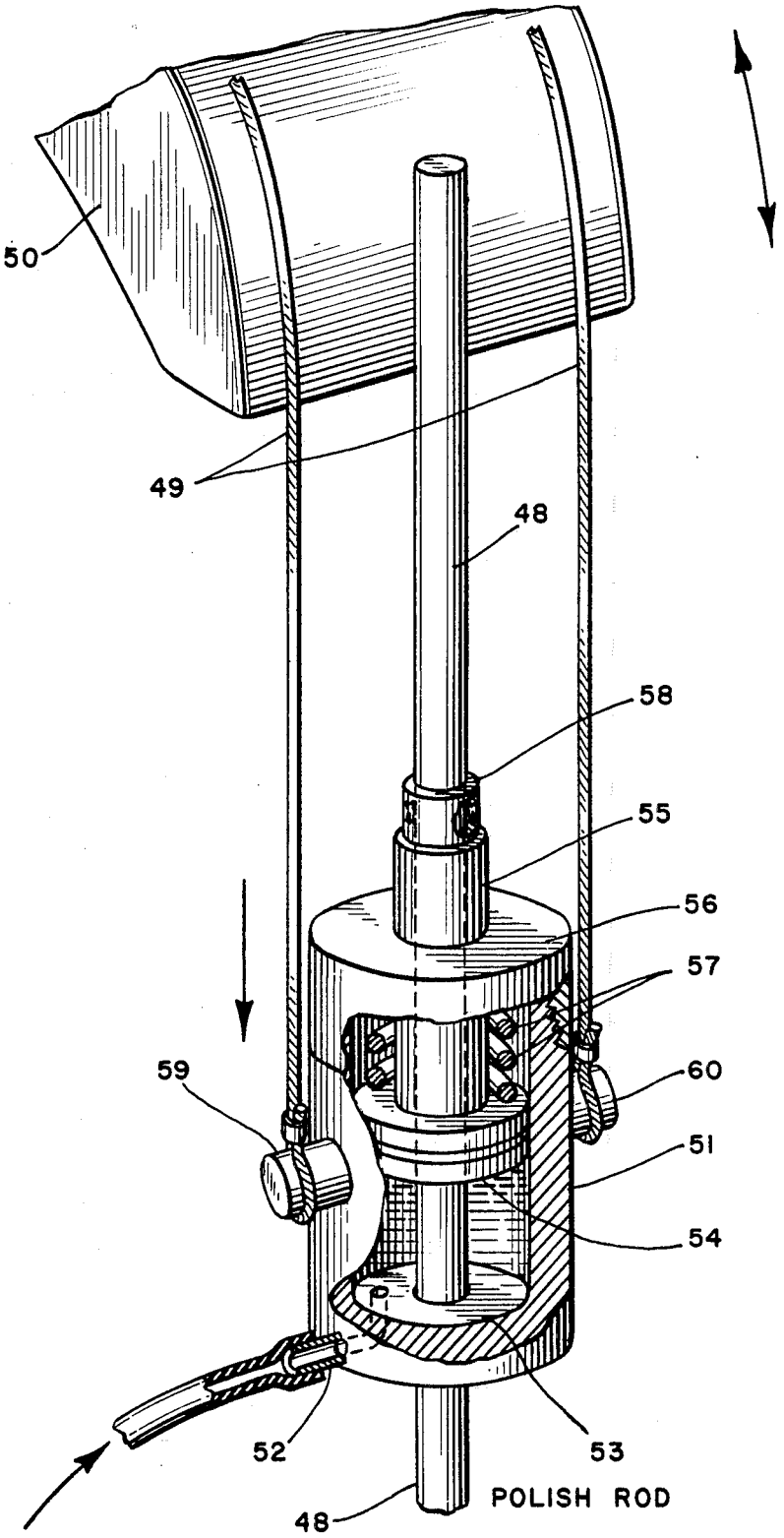
FIG. 5 is a fragmentary perpsective view of a preferred embodiment of the stroke extender.

More particularly and with reference to FIG. 5, there is shown a polish rod 48 extending upwardly between double cables 49 in turn connected to the horse head 50. Normally, a clamp secured to the cables 49 would engage directly the polish rod 48 at some desired distance from the upper end of the polish rod.

In place of such clamp, there is provided the preferred embodiment of the stroke extender which in most respects is the same in principle as the stroke extending described in FIGS. 1–4. Thus, there is provided a cylinder 51 having a hydraulic inlet 52 passing up through the floor 53 of the cylinder.

Positioned within the cylinder is a piston 54 having a piston portion 55, similar to the piston rod 26 in the first version but of somewhat larger diameter and of hollow construction so that the polish rod 48 can pass upwardly therethrough as shown. Piston portion 55 passes out the cylinder head 56. A compression spring 57 is positioned between the top of the piston 54 and the underside of the piston head 56.

A clamp 58 is secured to the upper end of the pistion portion 55 and serves to clamp the polish rod 48 at a desired location so that the polish rod is attached to the piston portion and thus the piston 54. The double cables 49 from the horse head, in turn, are attached to the sides of the cylinder 51 as at 59 and 60.

With the foregoing arrangment, it can be seen that when fluid is introduced into the cylinder, the piston portion 55 will be urged further out of the cylinder thereby extending the stroke of the polish rod relative to the horse head. Draining of the fluid decreases the stroke.

The operation of the extender of FIG. 5 is identical to that of FIGS. 1–4 except that the micro-switches A and B are interchanged so that as the polish rod is moving upwardly, fluid is introduced rather than drained and when the polish rod is moving downwardly, fluid is drained rather than introduced. It is assumed that the stroke is to be extended. If the stroke is to be decreased the micro-switches would remain in their positons shown in FIG. 1.

Stated somewhat differently, the only difference between the embodiment of FIG. 5 and that of FIGS. 1–4 is that the polish rod connects to the piston rather than the cylinder and the horse head connector cable (double cables) connect to the cylinder rather than to the polish rod.

From all of the foregoing, it will now be evident that the present invention has provied a useful product for adjusting the pump stroke of an oil well sub-surface pump.

The term "connector cable" as used herein includes the double cable construction of FIG. 5 as well as any single cable that might be used in a pump to exert an upward pull.

I claim:

1. An oil well sub-surface pump stroke extender for varying the stroke length of the polish rod of said pump including:

(a) telescoping means connected to said polish rod;

(b) first means for extending the overall length of said telescoping means as said polish rod approaches one end of its stroke;

(c) second means for retracting the overall length of said telescoping means as said polish rod qpproaches the opposite end of its stroke; and (d) means for controlling the amount by which said overall length is extended in a manner permitting the stroke length of the polish rod to be changed from one stroke cycle to another.

2. The subject mattter of claim 1, in which said telescoping means includes a cylinder and a piston in said cylinder.

3. The subject matter of claim 2, including a source of hydraulic fluid, said first means including means for introducing said hydraulic fluid into said cylinder and said second means including means for draining hydraulic fluid from said cylinder.

4. An oil well sub-surface pump stroke extender for adjusting the stroke of a polish rod normally attached to the connector cable of an oscillating horse driven by a power source in the filed, said extender including, in combination:

(a) a cylinder having an inlet passing through the floor of the cylinder;

(b) a piston in said cylinder having a piston rod extending through the head of the cylinder;

(c) a compression spring between the top of said piston and the underside of the head of said cylinder urging said piston towards the floor of said cylinder;

(d) means for attaching said piston portion and cylinder between said polish rod and said connector cable for said oscillating horse head;

(e) hydraulic fluid inlet control means responsive to a first given postion of said horse head to introduce hydraulic fluid into said cylinder to extend said piston portion further from the head of said cylinder thereby changing the distance between said horse head and said polish rod; and (f) hydraulic fluid drain means responsive to a second given position of said horse head to drain hydraulic fluid from said cylinder thereby causing retraction of said piston portion into said cylinder by said spring thereby again changing the distance between said horse head and said polish rod; and (e) means for changing the first and second given positions thereby to vary the extent by which the distance between the horse head and polish rod is changed by said piston.

5. The subject matter of claim 4, in which said polish rod is attached to said cylinder and said piston rod is attached to said connector cable and in which said first given position of said horse head is the uppermost position it assumes and said second given position of said horse head is the lowermost position it assumes, whereby said stroke is extended by a distance corresponding to the travel distance of said piston relative to said cylinder.

6. The subject matter of claim 4, in which said polish rod is attached to said piston rod and said cylinder is attached to said connector cable and in which said first given position of said horse head is the lowermost position it assumes and said second given position of said horse head is the uppermost position it assumes, whereby said stroke is extended by a distance corresponding to the travel distance of said piston relative to said cylinder.

7. The subject matter of claim 4, including means for adjusting the travel distance of said piston.

8. The subject matter of claim 7, including a hydraulic pump for transferring hydraulic fluid into said cylinder, said means for adjusting the travel distance of said piston comprising means for varying the rate of hydraulic fluid flow from said pump into said cylinder.

9. In an oil well pump having an oscillatory horse head for reciprocally driving a polish rod extending downwardly into a well, said polsih rod having a normal stroke according to the magnitude of oscillation of said horse head, the improvement comprising:

(a) telescopic means having first and second components movable relative to each other between extended and retracted positions, said first and second components being coupled respectively to said horse head and to said polish rod;

(b) means for moving said first and second components relative to each other from an initial position generally as said polish rod approaches one end of its normal stroke to vary the length of the actual stroke of said polish rod, said moving means including means for returning said components to said initial position prior to return movement of said polish rod approaching said one end of said normal stroke; and (c) means for controlling the amount said first and second components are moved relative to each other in a manner enabling said amount to be changed so as to change the actual stroke length of the polish rod achieved during one oscillation cycle of the horse head relative to that achieved in another oscillation cycle of the horse head.

10. The improvement of claim 9 further including means for variably adjusting the magnitude of movement of said first and second components from said initial position to correspondingly variably adjust the length of said polish rod actual stroke.

11. The improvement of claim 9 wherein said moving means displaces said first and second components relative to each other from said initial position in a direction increasing the length of the actual stroke of said polish rod.

12. The improvement of claim 9 wherein said moving means displaces said first and second components relative to each other from said initial position in a direction decreasing the length of the actual stroke of said polish rod.

13. The improvement of claim 9 wherein said first and second components of said telescopic means comprise a cylinder and a piston slidably received within said cylinder.

14. The improvement of claim 13 wherein said moving means includes hydraulic fluid supply means for supplying hydraulic fluid under pressure into said cylinder for moving said piston and cylinder relative to each other from an initial position generally as said polish rod approaches one end of its normal stroke, and means for draining the hydraulic fluid from said cylinder in combination with spring means for returning said piston and cylinder to their initial position.

* * * * *